US005375839A

United States Patent [19]

Pagani

[11] Patent Number: 5,375,839

[45] Date of Patent: Dec. 27, 1994

[54] IMPACT SENSITIVE TALKING BALL

[75] Inventor: David A. Pagani, Montpelier, Vt.

[73] Assignee: New Ventures, Inc., Montpelier, Vt.

[21] Appl. No.: 65,667

[22] Filed: May 21, 1993

[30] Foreign Application Priority Data

Nov. 19, 1992 [GB] United Kingdom ..... 9224313

[51] Int. Cl.[5] ..... A63B 37/00; A63H 5/00

[52] U.S. Cl. ..... 273/58 E; 446/409

[58] Field of Search ..... 446/242, 265, 297, 397, 446/409, 486; 273/58 R, 213, 58 E, 58 G

[56] References Cited

U.S. PATENT DOCUMENTS

| | | | |
|---|---|---|---|
| 3,580,575 | 5/1971 | Speeth | 273/58 G |
| 3,798,833 | 3/1974 | Campbell | 273/161 |
| 4,577,865 | 3/1986 | Shishido | 273/58 G |
| 4,595,200 | 6/1986 | Shishido | 273/58 E |
| 4,662,260 | 5/1987 | Rumsey | 273/58 E |
| 4,737,134 | 4/1988 | Rumsey | 273/58 G |
| 4,765,623 | 8/1988 | Cardillo | 273/161 |
| 4,801,141 | 1/1989 | Rumsey | 273/58 E |
| 4,931,029 | 6/1990 | Hwang | 446/397 |
| 5,049,107 | 9/1991 | DeNittis | 273/58 E |
| 5,066,011 | 11/1991 | Dykstra et al. | 273/58 G |
| 5,145,473 | 9/1992 | Henry | 273/58 G |
| 5,203,560 | 4/1993 | Wang | 273/58 E |
| 5,236,383 | 8/1993 | Connelly | 273/58 G |

FOREIGN PATENT DOCUMENTS

| | | | |
|---|---|---|---|
| 3123387 | 1/1983 | Germany | 446/397 |
| 2213069 | 8/1989 | United Kingdom | 273/58 E |

*Primary Examiner*—Robert A. Hafer
*Assistant Examiner*—Jeffrey D. Carlson
*Attorney, Agent, or Firm*—Thompson Hine & Flory

[57] ABSTRACT

A talking ball has a speaking unit mounted inside including an adapter 30 which fits in an aperture in the ball to hold the unit in position. A plunger 21 fits against an inside surface and operates a test switch 16 when the ball is squeezed. The speaking unit is provided with a voice record chip, batteries and a vibration switch. When the ball is hit or bounced a message broadcast is initiated by the vibration switch.

10 Claims, 3 Drawing Sheets

IMPACT SENSITIVE TALKING BALL

BACKGROUND OF THE INVENTION

The invention relates to a talking ball or the like.

It is known to provide toys which incorporate voice record chips that are activated to broadcast appropriate noises or messages during play to make the toy more versatile and attractive to play with. The present invention relates to bails or other similar articles that are generally thrown around during play and to speaking units that are arranged to fit inside the ball or other article.

SUMMARY OF THE INVENTION

According to the invention there is provided a speaking unit for a hollow ball or the like, the unit comprising a housing incorporating electrical components including a voice message chip, a vibration switch, a loudspeaker and a battery power supply compartment, and an adapter to hold the housing in the ball which is formed with peripheral formations which cooperate with edges of an aperture formed in a wall of the ball, the adapter having a perforated front surface which covers the aperture and lies flush with the surface of the ball which surrounds the aperture.

A mechanically operated electric switch may be mounted in the housing and a plunger extending from the housing to adjacent an inner surface of the ball arranged to operate the switch whenever the ball is squeezed such that the inside surface presses the plunger against the switch.

The unit may include a loudspeaker cover attached to the housing and having a nose extending forwards of the housing, in which the adapter fits around and grips the nose.

The adapter may have a peripheral rim, arranged to fit against a lip extending around the aperture to hold the adapter away from the centre of the ball, and have one or more flanges next to the rim which fit behind the lips to hold the adapter towards the centre of the ball. There may be a number of flanges corresponding to slots in the lip which allow the flanges to pass the lip unhindered during assembly of the speaking unit into the ball.

A ball incorporating a speaking unit according to the invention will now be described by way of example with reference to the accompanying drawings.

DETAIL DESCRIPTION

Figure 1:
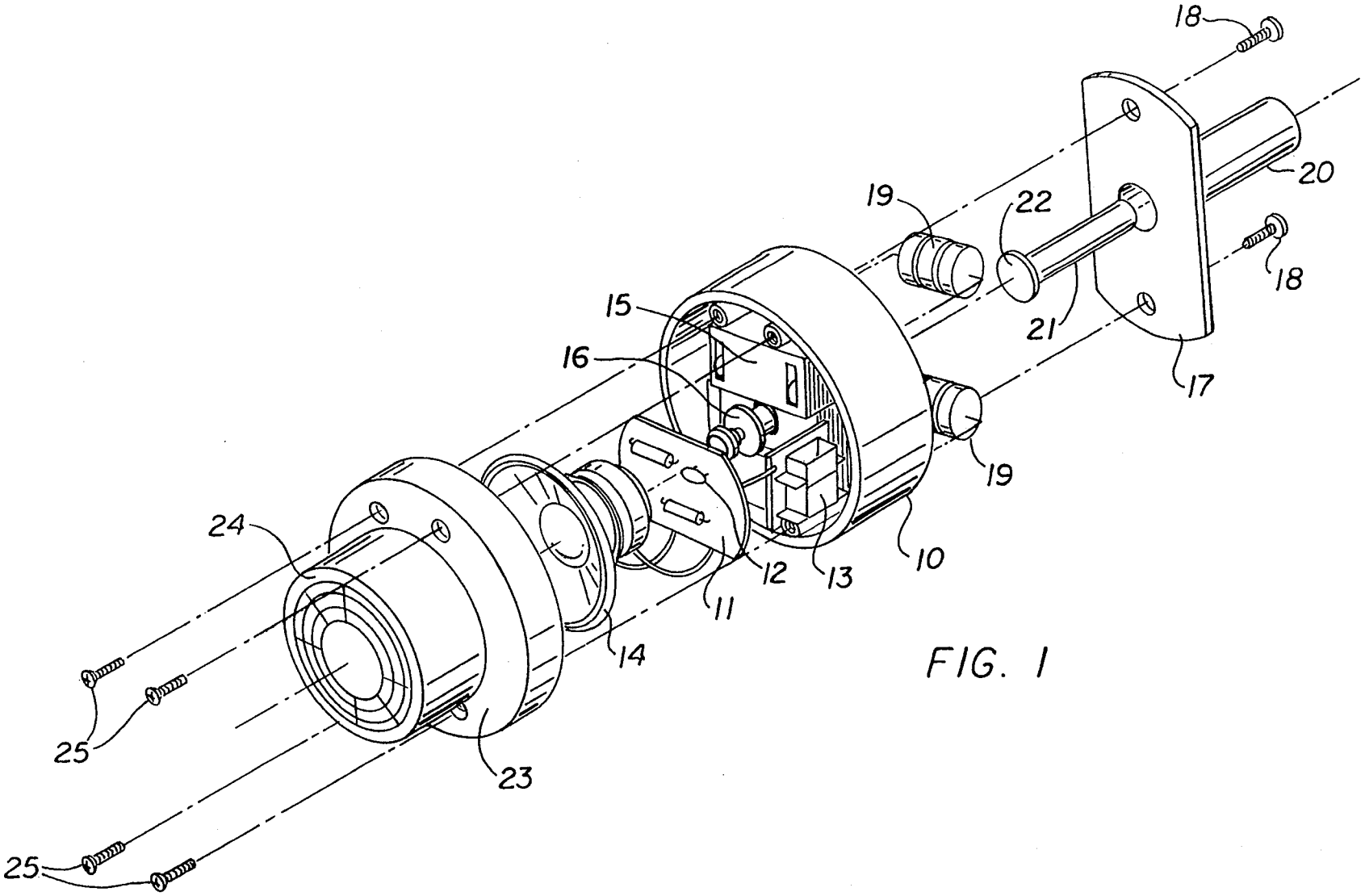
FIG. 1 is an exploded isometric view of the speaking unit.

Referring to the drawings, in FIG. 1 the speaking unit is formed with a short cylindrical plastic housing 10 which incorporates and has mounted therein a printed circuit board 11 supporting a voice chip 12, a vibration switch 13, a loudspeaker 14, and two battery compartments 15, (only one can be seen in the Figure) at either side of an electrical test button 16. The test button 16 is mounted against a rear surface of the printed circuit board 11. A lid 17 fits on the rear of the housing 10 and is held in position by screws 18 to hold batteries 19 in the compartments 15. A hollow tube 20 is mounted centrally on the lid 17 and extends rearwards away from the housing 10. A plunger 21 slidingly fits into the tube 20 and has an enlarged head 22 aligned with the test button 16. A speaker cover 23 fits over the loudspeaker 14 and has a cylindrical nose 24 which extends well forwards from the housing 10. The cover 23 is held to the housing 10 by screws 25.

Figure 2:
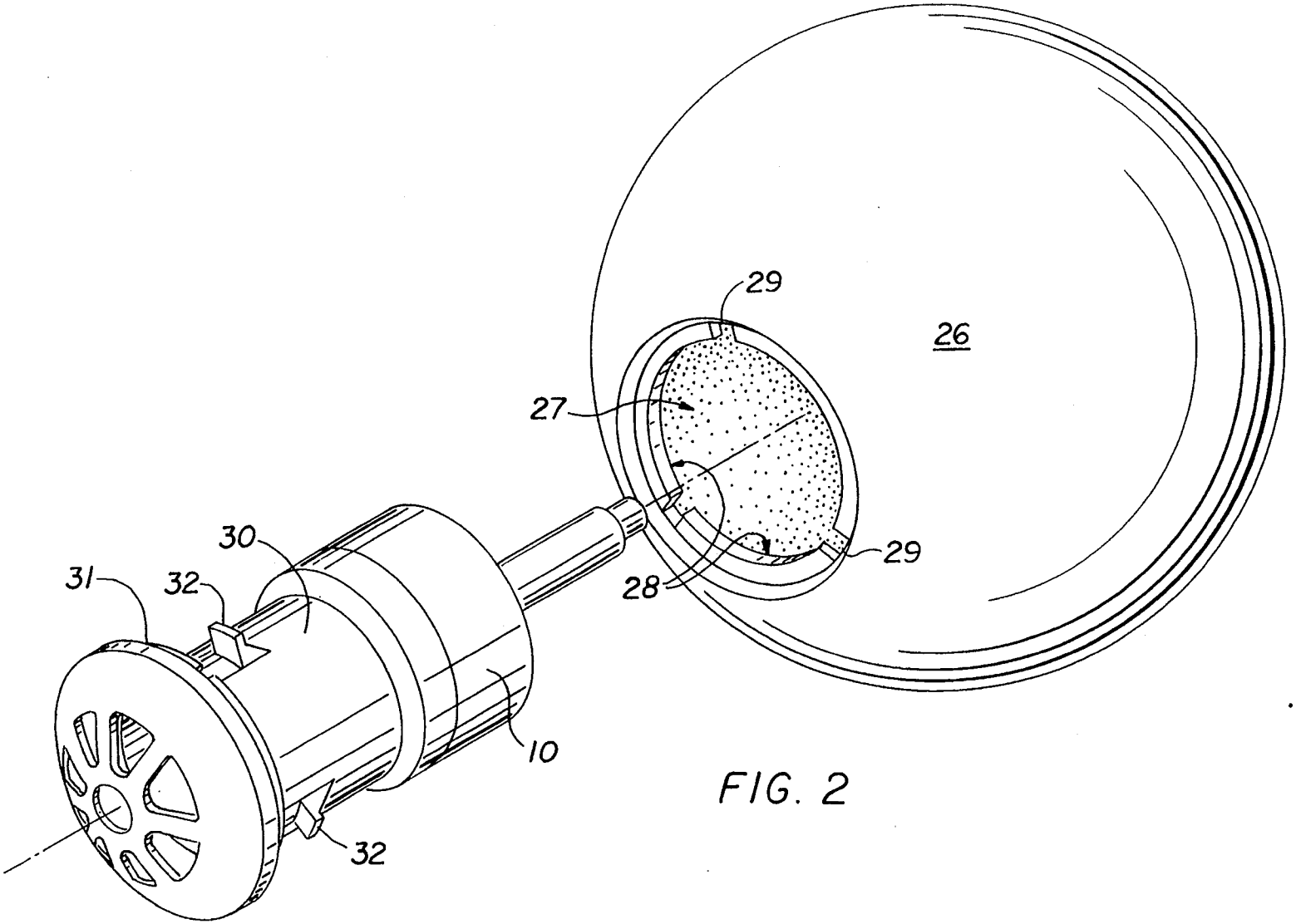
FIG. 2 is an isometric view of the speaking unit, with an adapter fitted, and a ball.

In FIG. 2, a ball 26 is formed of flexible plastics material and has a circular aperture 27 formed in its wall with lips 28 in which there are three slots 29. An adapter 30 which fits over and surrounds the nose 24 (FIG. 1) has a rim 31 and three flanges 32. A front surface of the adapter 30 has a number of holes or perforations formed therein. The rim 31 is arranged to fit snugly against the lips 28 and the flanges 32 to pass through the slots 29 to fit behind the lips 28. Thus, when the speaking unit is fitted it is pushed into the ball 26 through the aperture 27 and once the flanges 32 have passed the lips 28, the adapter is rotated so that the flanges 32 slide and lock behind the lips 28 and hold the adapter 30 and hence the speaking unit in position.

Figure 3:
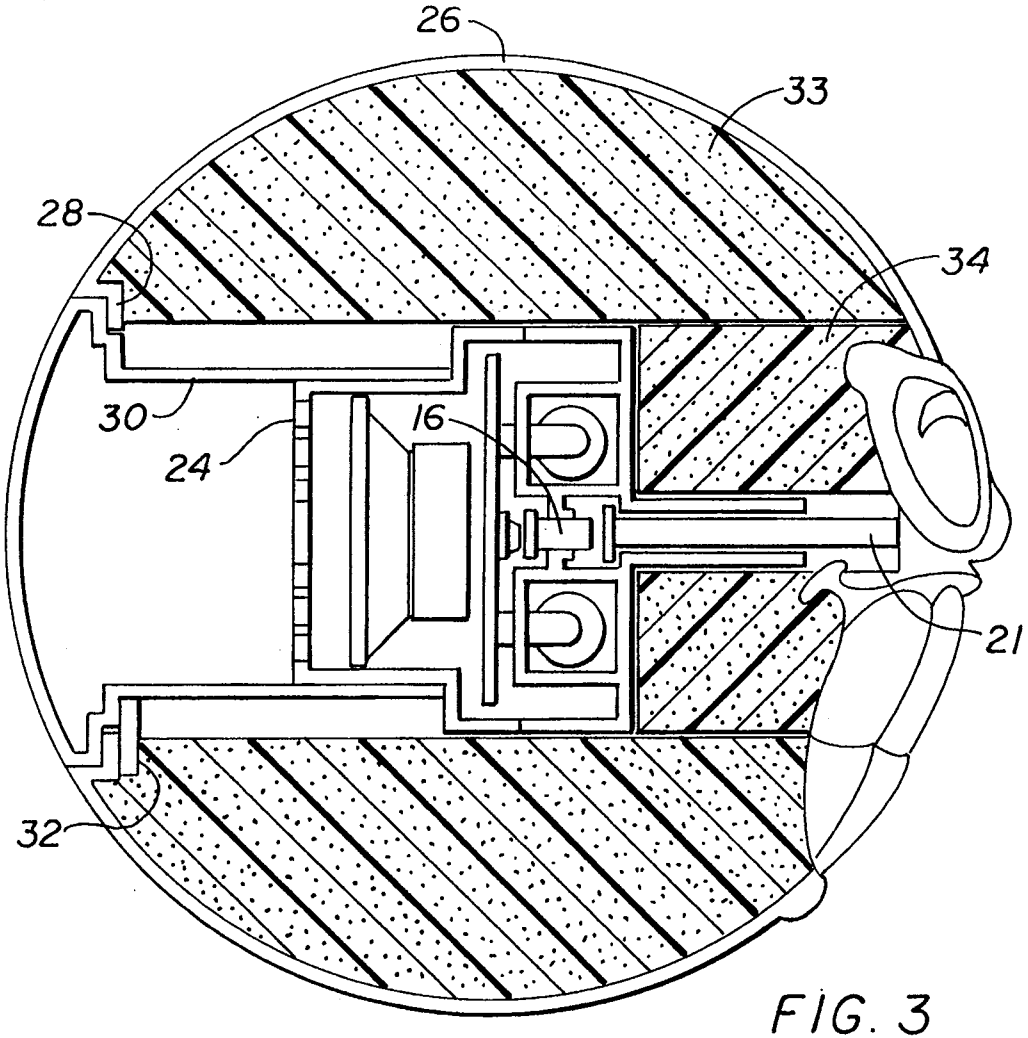
FIG. 3 is a cross-sectional side view of the speaking unit fitted inside the ball.

In FIG. 3, it will be seen that the ball is formed with an imitation face and that the remote end of the plunger 21 fits against a rear surface of the ball in the centre of the face. If the face is pressed in, the plunger 21 is pushed against the test switch 16 and activates the voice chip to broadcast a message. A broadcast will also be produced if the ball is vibrated sufficiently to activate the vibration switch 13 (FIG. 1).

It will be noted that the front surface of the adapter 30 conforms to the outer surface of the ball and fits flush with the cuter surface that surrounds the aperture 27. The inside of the ball can be and is preferably filled with plastics foam inserts as shown. A relatively large insert 33 and a smaller insert 34 help support the speaking unit in position and hold it centrally within the ball. Preferably, the components of the speaking unit, especially the loudspeaker and batteries, are held generally centrally in the ball 26 so that the ball is not untowardly unevenly balanced due to any significant off-center weighting.

It will be noted that the described speaking unit can be readily adapted to fit a range of different sizes of balls. This is because the length of the plunger 21 is easily changed and the adapter 30 can slide somewhat along the nose 24 and be fixed by rivots or glue in chosen different positions relative to the nose 24. Also, it will be noted that the unit can not only be quickly and simply fitted into the ball (as is especially attractive for mass production assembly) but can also be removed temporarily to allow the batteries to be replaced when required. Normally, the ball is used for throwing or hitting and the vibration switch 13 set to respond to only relatively significant impacts. The message provided on such occurrences may be a single message or multiple messages provided in predictable or random sequence as desired. The vibration switch 13 may also be arranged to respond to different magnitudes of impact and initiate different and respective message broadcasts. Normally, and as described, the plunger 21 is used simply to test the speaking unit but may be used as part of a game to generate a special message when a particular part (near the end of the plunger) of the ball is squeezed in or impacted by a bat or by bouncing the ball against that part.

Thus, embodiments of the invention provide generally utility balls suitable for vigorous and safe play at all ages. The speaking unit interferes very little with the normal behaviour of each ball as such. The unit never-the-less is well and safely supported inside the ball and can be easily assembled in the ball initially as well as removed to change the batteries when required.

I claim:

1. An impact sensitive talking ball comprising:

a speaking unit having a housing enclosing a voice message chip, a vibration switch, a loudspeaker and a battery power supply compartment;

an adapter for holding said speaking unit in said ball, said adapter including peripheral formations which cooperate with edges of an aperture formed in a surface of said ball, said adapter having a perforated front surface covering said aperture and lying flush with said ball surface surrounding said aperture;

a mechanically operated electric switch mounted in said housing; and a plunger extending from said housing to adjacent an inner surface of said ball, said plunger arranged to operate said electric switch whenever said ball is squeezed, such that said inner surface presses said plunger against said electric switch.

2. A talking ball comprising:

a speaking unit having a housing enclosing a voice message chip, a vibration switch, a loudspeaker and a battery power supply compartment;

an adapter for holding said speaking unit in said ball, said adapter including peripheral formations which cooperate with edges of an aperture formed in a surface of said ball, said adapter having a perforated front surface covering said aperture and lying flush with said ball surface surrounding said aperture; and a loudspeaker cover attached to said housing, said cover having a nose extending forwards of said housing, said adapter fitting around and gripping said nose.

3. A sound-emitting toy comprising:

a sound unit having a housing enclosing a vibration switch, a loudspeaker, a battery power supply compartment, and means for emitting predetermined sound;

an adapter for holding said sound unit in said toy, said adapter including peripheral formations which cooperate with edges of an aperture formed in a surface of said toy, said adapter having a perforated front surface covering said aperture and being flush with said toy surface surrounding said aperture;

a mechanically operated electric switch mounted in said housing and connected to activate said sound unit; and a plunger extending from said housing to an inner surface of said toy, said plunger being positioned to operate said electric switch when said toy is squeezed, such that said inner surface presses said plunger against said electric switch to close said switch and activate said sound unit.

4. A sound-emitting toy comprising:

a sound unit having a housing enclosing a vibration switch, a loudspeaker, a battery power supply compartment and means for emitting predetermined sound;

an adapter for holding said sound unit in said toy, said adapter including peripheral formations which cooperate with edges of an aperture formed in a surface of said toy, said adapter having a perforated front surface covering said aperture and being flush with said toy surface surrounding said aperture; and a loudspeaker cover attached to said housing, said cover having a nose extending forwards of said housing, said adapter fitting around and gripping said nose.

5. The toy of claim 3 wherein said sound is speech.

6. The toy of claim 5 wherein said sound emitting means is a voice message chip.

7. The toy of claim 6 wherein said toy is a ball.

8. The toy of claim 4 wherein said sound is speech.

9. The toy of claim 8 wherein said sound emitting means is a voice message chip.

10. The toy of claim 9, wherein said toy is a ball.

* * * * *